US009220355B2

(12) United States Patent
Squitieri

(10) Patent No.: US 9,220,355 B2
(45) Date of Patent: Dec. 29, 2015

(54) SHELF AND MERCHANDISE DISPLAY SYSTEM HAVING STOWABLE LANE DIVIDERS

(71) Applicant: Anthony C. Squitieri, Monroe, CT (US)

(72) Inventor: Anthony C. Squitieri, Monroe, CT (US)

(73) Assignee: MECHTRONICS CORPORATION, Beacon, NY (US)

( * ) Notice: Subject to any disclaimer, the term of this patent is extended or adjusted under 35 U.S.C. 154(b) by 0 days.

(21) Appl. No.: 14/092,045

(22) Filed: Nov. 27, 2013

(65) Prior Publication Data

US 2014/0319089 A1 Oct. 30, 2014

Related U.S. Application Data

(63) Continuation of application No. 13/833,218, filed on Mar. 15, 2013, now abandoned, which is a continuation-in-part of application No. 12/337,995, filed on Dec. 18, 2008, now Pat. No. 8,651,288.

(60) Provisional application No. 61/015,477, filed on Dec. 20, 2007.

(51) Int. Cl.
*A47F 1/12* (2006.01)
*A47F 5/00* (2006.01)

(52) U.S. Cl.
CPC .. *A47F 5/005* (2013.01); *A47F 1/12* (2013.01)

(58) Field of Classification Search
CPC ..... A47F 5/005; A47F 1/12
USPC ..... 211/59.2, 59.3, 74, 184; 312/35, 42, 45, 312/61, 71; 108/60, 61; 221/118, 130, 131
See application file for complete search history.

(56) References Cited

U.S. PATENT DOCUMENTS

| | | | | | |
|---|---|---|---|---|---|
| 5,333,745 | A * | 8/1994 | Lehmann | 211/88.01 |
| 5,351,839 | A * | 10/1994 | Beeler et al. | 211/59.3 |
| 5,353,939 | A * | 10/1994 | Beeler et al. | 211/59.3 |
| 6,651,828 | B2 * | 11/2003 | Dimattio et al. | 211/59.2 |
| D486,324 | S * | 2/2004 | Mason | D6/473 |
| D489,556 | S * | 5/2004 | Mason | D6/511 |
| D496,193 | S * | 9/2004 | Mason | D6/468 |
| 7,131,543 | B2 * | 11/2006 | Mason | 211/59.2 |
| 8,602,226 | B1 * | 12/2013 | Chen et al. | 211/59.4 |
| 8,651,288 | B2 * | 2/2014 | Squitieri | 211/59.2 |
| D701,408 | S * | 3/2014 | Mason et al. | D6/705.7 |
| 2003/0066811 | A1 * | 4/2003 | Dimattio et al. | 211/59.2 |
| 2004/0211736 | A1 * | 10/2004 | Mason | 211/59.2 |
| 2006/0011565 | A1 * | 1/2006 | Pirro et al. | 211/59.2 |
| 2009/0159546 | A1 * | 6/2009 | Squitieri | 211/153 |

* cited by examiner

*Primary Examiner* — Joshua Rodden
(74) *Attorney, Agent, or Firm* — MKG LLC

(57) ABSTRACT

A merchandise display system is presented. The display system includes a support frame, a plurality of shelves disposed on the support frame, and a plurality of divider walls moveably secured to each shelf. Each shelf includes a base defining an arcuate upper surface having one or more channels formed therein. The divider walls are selectively positionable in a deployed position and/or a stowed position. In the deployed position the divider walls extend above the arcuate upper surface and in the stowed position the divider walls are disposed in the channel and are recessed below or level with the arcuate surface. In the deployed position, pairs of the divider walls cooperate with one another and the arcuate upper surface to define a lane therebetween. The lane is dimensioned to accommodate a front to back column of merchandise items.

16 Claims, 12 Drawing Sheets

SHELF AND MERCHANDISE DISPLAY SYSTEM HAVING STOWABLE LANE DIVIDERS

CROSS-REFERENCE TO RELATED APPLICATIONS

This application is a continuation of and claims priority to copending U.S. patent application Ser. No. 13/833,218, filed Mar. 15, 2013, which is a continuation in part of U.S. patent application Ser. No. 12/337,995, filed Dec. 18, 2008, which claims priority benefit under 35 U.S.C. §119(e) to U.S. Provisional Patent Application Ser. No. 61/015,477, filed Dec. 20, 2007, the disclosure of these U.S. patent applications are incorporated by reference herein in their entirety.

BACKGROUND OF THE INVENTION

1. Field of the Invention

This invention relates to merchandise and/or product display systems designed to present modular merchandise units to prospective consumers in an improved gravity feed arrangement and, in particular, to a merchandise display system having shelves equipped with stowable lane dividers capable of being selectively positionable relative to the shelves in a stowed and/or deployed position.

2. Description of Related Art

Consumer merchandise including, for example, batteries, are placed in a primary product package. A number of primary product packages are typically assembled within a modular merchandise unit or box, referred to as a MOD or PDQ, for shipment to a retailer. When received at a retail location, the retailer removes an upper portion of the modular merchandise unit to reveal the consumer merchandise in its primary packaging stored therein. The modular merchandise unit is then directly loaded onto a shelf of a display system that presents the merchandise to a potential consumer within the modular merchandise unit without the need for additional setup. Typically, two or more modular merchandise units are loaded on each shelf in a column arrangement traversing a depth of the shelf from a front dispensing end to a rear end.

As noted above, the modular merchandise units are typically boxes having a substantially flat bottom surface that rides on the shelves of the display system by gravity feed, as is known in the art. If an angle of incline of each of the shelves is too steep, the modular merchandise units can tilt forward and rotate such that the bottom surface of the modular merchandise units are no longer in contact with the shelf. Such tilt and rotation can result in modular merchandise units jamming within the column, or can result in the consumer merchandise not being presented in a preferred manner, e.g., with product information on a front surface of the primary product package clearly visible at the front dispensing end of the display device. For example, unwanted rotation of the modular merchandise unit can cause the front of the modular merchandise unit and, thus of the primary product packaging, intended for display to customers to flip over or turn before reaching the dispensing end of the shelf so that a wrong side or rear of the primary product packaging is visible to prospective consumers at the front dispensing end.

Prior art display devices have attempted to minimize such adverse tilt and rotation by configuring shelves with lanes or channels, each channel including two spaced apart walls and a floor. The channel provides a moderate incline for merchandise units to travel upon such as, for example, between an about seventeen degree (17°) incline and an about twenty-two degree (22°) or an about twenty-four degree (24°) incline relative to a horizontal shelf. One perceived deficiency in using shelves having only the above described moderate incline is that there is often insufficient gravitational force acting on a last modular merchandising unit in the column of units in a channel such that one or more of the units within the column fails to advance to the correct presentation position at the front dispensing end of the shelf.

Accordingly, the inventor has recognized that there is a need for a shelf for a merchandise display system that receives modular merchandise units and that allows the units to descend by gravity from the rear end of the shelf to the front, dispensing end of the shelf in a correct orientation (e.g., substantially upright and forward facing) so that merchandise and product information regarding the merchandise on the primary product packaging is clearly visible to prospective consumers.

SUMMARY OF THE INVENTION

The present invention includes a merchandise display system. The display system includes a support frame, a plurality of shelves disposed on the support frame, and a plurality of divider walls affixed to or removably installable on the shelves. Each shelf includes a base having a plurality of arcuate surfaces. In one embodiment, the base includes a left side wall, a right side wall, a front wall and a rear wall. In one embodiment, the arcuate surfaces, the left side wall, the right side wall and the dividers cooperate to define a plurality of lanes on each shelf. Each lane is dimensioned to accommodate a front to back column of merchandise items. When a merchandise item is placed at a rear portion of one of the lanes, the merchandise item traverses the lane by gravity to a forward portion of the lane such that the merchandise item is presented to a prospective consumer in a substantially upright and forward facing position.

In one aspect of the invention, each of the plurality of arcuate surfaces of the shelves of the merchandise display system is formed as a plurality of surfaces extending continuously as tangent radii from the front dispensing end to the rear end of the base. In one embodiment, the merchandise items exhibited on the display system include a plurality of modular merchandise units. Each of the modular merchandise units retains a plurality of primary merchandise packaging for consumer merchandise such as, for example, batteries.

In another aspect of the invention, a gravity-feed shelf for a merchandise display system is provided. The shelf includes a base having a left side wall, a right side wall, and an arcuate upper surface disposed between the left side wall and the right side wall to define a lane. The lane is dimensioned to accommodate a front to back column of merchandise items. When a merchandise item is placed at a rear portion of the lane, the merchandise item traverses the lane by gravity to a forward portion of the lane such that the merchandise item is presented to a prospective consumer in a substantially upright and forward facing position.

In yet another aspect of the invention, the divider walls are selectively positionable in a deployed position and/or a stowed position. In the deployed position, the divider walls extend above the arcuate upper surface; and in the stowed position the divider walls are disposed in the channel and are recessed below or are level with the arcuate surface. In the deployed position, pairs of the divider walls cooperate with one another and the arcuate upper surface to define a lane therebetween.

The divider walls may include one or more projections extending therefrom and the channels may include one or more slots extending therethrough. Each of the projections can be selectively positioned in one of the slots, to moveably secure the divider wall in the deployed position and/or the stowed position.

In addition, the projections can include a first finger and a second finger spaced apart from one another. The slots can have one or more abutment surfaces disposed therein. Each of the first and second fingers can selectively engage one of the abutment surfaces to moveably secure the divider wall in the deployed position and/or the stowed position. The first finger and/or the second finger can include a first recess which cooperates with one of the abutment surfaces to selectively secure the divider wall in the deployed position and a second recess which cooperates with the abutment surface to selectively secure the divider wall in the stowed position.

BRIEF DESCRIPTION OF THE DRAWINGS

The features and advantages of the present invention will be better understood when the Detailed Description of the Preferred Embodiments given below is considered in conjunction with the figures provided.

In these figures like structures are assigned like reference numerals, but may not be referenced in the description of all figures.

DETAILED DESCRIPTION OF THE PREFERRED EMBODIMENTS

Figure 1:
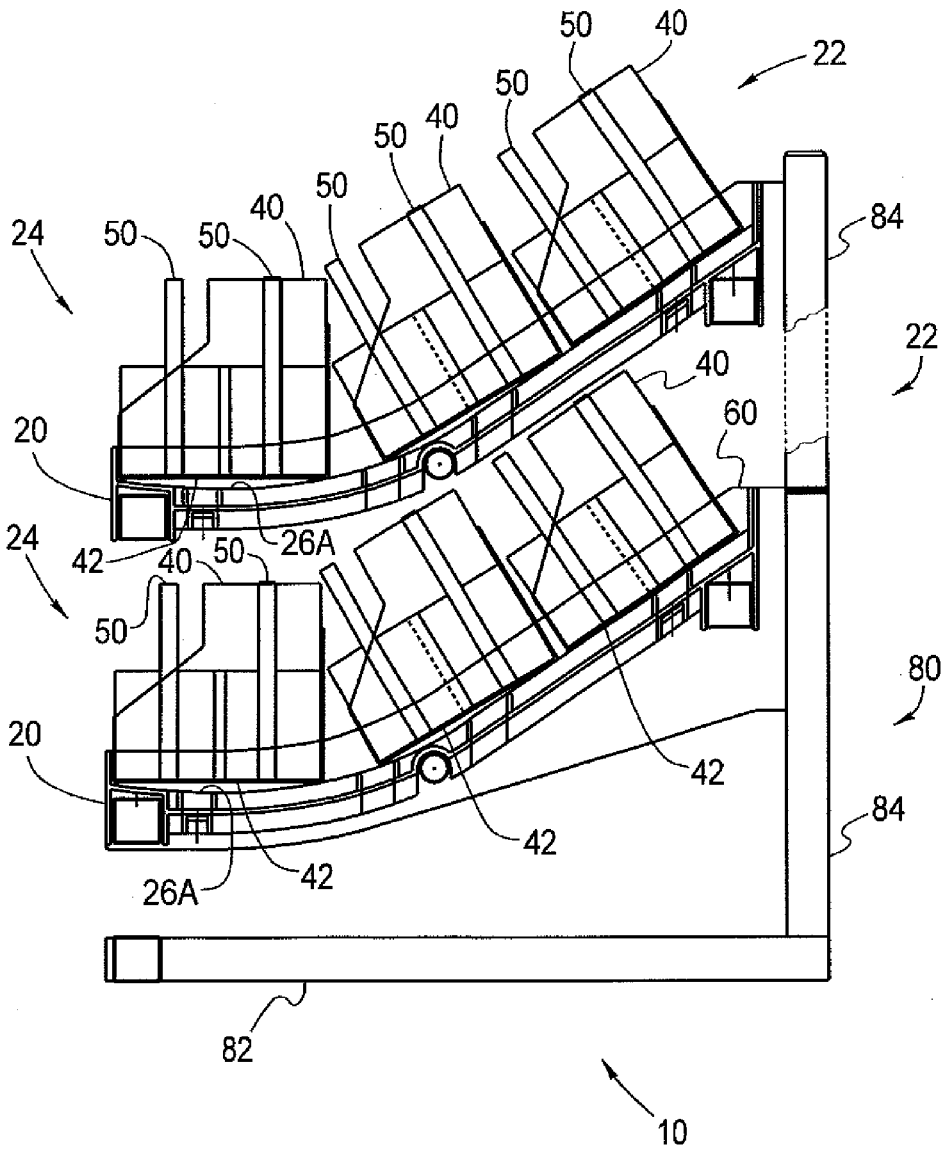
FIG. 1 is a side, partially cross-sectional view of a merchandise display system having shelves presenting modular merchandise units and consumer merchandise stored therein to potential consumers in an improved gravity feed arrangement, in accordance with one embodiment of the present invention.

FIG. 1 illustrates a merchandise display system 10 having a plurality of shelves 20 arranged to receive modular merchandise units 40 and allow the units 40 to descend by gravity from a rear end 22 of the shelves 20 to a front dispensing end 24 of the shelves 20. As shown in FIG. 1, the modular merchandise units 40 retain a plurality of primary product packaging 50 for consumer merchandise such as, for example, batteries and the like. In accordance with the present invention, a base 42 of each of the modular merchandise units 40 traverses the shelves 20 such that the modular merchandise units 40 and the primary product packaging 50 retained therein are presented to prospective consumers at the front dispensing end 24 in a substantially upright and forward facing position.

Figure 3:
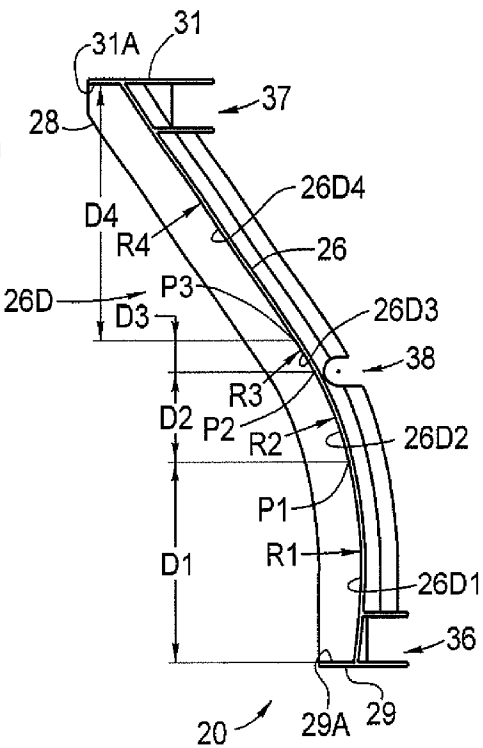
FIG. 3 is a side, cross-sectional view of the shelf of FIG. 2, taken along line 3-3 of FIG. 2.
Figure 2:
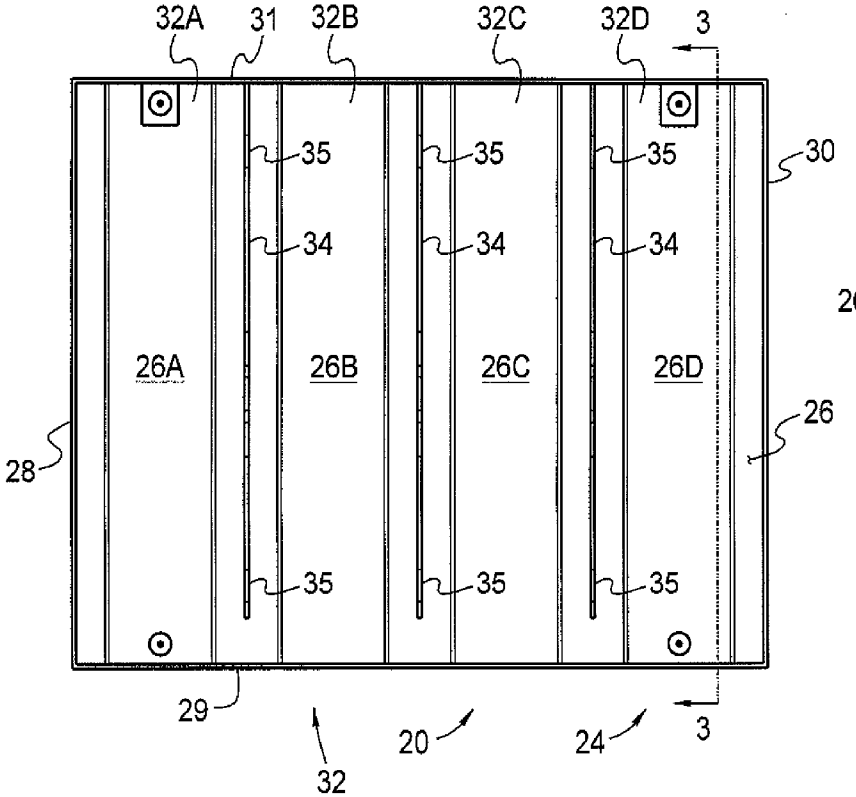
FIG. 2 is a plan view of a shelf as illustrated in FIG. 1, in accordance with one embodiment of the invention.

One embodiment of the shelves 20 is illustrated in FIGS. 2 and 3. As shown, each shelf 20 includes a base 26, a left side wall 28 and a right side wall 30 (left and right are from the perspective of a prospective consumer facing the front, dispensing end 24 of the merchandising display system 10). In one embodiment, the base 26 also includes a front wall 29 and a rear wall 31. The front wall 29 acts as a stop inhibiting the modular merchandise units 40 from being inadvertently discharged from the display system 10 by the weight of and/or pressure applied by subsequent merchandise units 40 in the column of units 40 on the shelf 20. In one embodiment, the base 26, the left side wall 28, the right side wall 30, the front wall 29 and the rear wall 31 are formed as a unitary member such as, for example, a molded plastic assembly comprised of at least one of a medium impact polycarbonate, polypropylene, styrene and like material.

When assembled, the merchandise display system 10 includes a plurality of dividers or wall members 60 (FIGS. 5A and 5B) that are coupled to the base 26 of the shelf 20. In one embodiment, the wall members 60 are removably insertable on the base 26. In another embodiment, the wall members 60 are affixed to the base 26 or integrally formed with the base 26. The base 26 and the wall members 60 cooperate to divide the shelf 20 into a plurality of lanes 32 (FIG. 2) from a left most lane 32A to a right most lane 32D. Each of the lanes 32 has a width and length effective to accommodate an associated front-to-back column of the modular merchandise units 40, as illustrated in FIG. 1. In one embodiment, the base 26 includes a plurality of channels 34 configured for receiving, as described below, a corresponding one of the plurality of dividers 60. In one embodiment, the channels 34 are disposed laterally and in a front to back arrangement along the base 26 to define the lanes 32. In one embodiment, the channels 34 include corresponding sets of channels disposed in proximity to each other such that a width of one or more of the lanes 34 may be adjusted (e.g., widened or narrowed) at assembly to accommodate various widths of the merchandising units 40. For example, by selectively inserting the dividers 60 into the sets of channels, the lane 32A may be configured having a lesser width than the width of the lane 32B, and so on for each of the plurality of lanes 32.

As is best shown in FIGS. 2 and 3, the base 26 includes a plurality of arcuate upper surfaces 26A-26D, each surface extending continuously upwardly from the dispensing end 24 to the rear end 22. In one embodiment, the arcuate upper surfaces 26A-26D are each formed as a plurality of surfaces comprised of several tangent radii, e.g., two, three, four, five or more radii with tangents that cooperate to form each of the continuous arcuate upper surfaces 26A-26D. For example, and as illustrated in FIG. 3, the arcuate upper surface 26D includes a plurality of surfaces 26D1, 26D2, 26D3 and 26D4 formed as tangent radii, radii R1-R4. In one embodiment, the surface 26D1 extends the radius R1 from an inside surface 29A of the front wall 29 to a point P1 at a dimension D1 from the inside surface 29A of wall 29, the surface 26D2 extends the radius R2 from the point P1 to a point P2 at a dimension D2 from the point P1, the surface 26D3 extends the radius R3 from the point P2 to a point P3 at a dimension D3 from the point P2, and the surface 26D4 extends the radius R4 from the point P3 to an inner surface 31A of the rear wall 31 at a dimension D4. In one embodiment, the radius R1 is about 13.7 inches (34.8 centimeters (cm)) and the dimension D1 is about 4.4 inches (11.2 cm), the radius R2 is about 8.3 inches (21.1 cm) and the dimension D2 is about 2.7 inches (6.9 cm), the radius R3 is about 20.2 inches (51.3 cm) and the dimension D3 is about 0.8 inch (2.0 cm), and the radius R4 is about 65.38 inches (166.1 cm) and the dimension D4 is about 6.6 inches (16.8 cm). It should be appreciated that it is within the scope of the present invention to vary the radii R1-R4 and dimensions D1-D4 to improve the operative flow of the modular merchandise units 40 by gravity feed from the rear end 22 to the dispensing end 24.

In view thereof, each of the lanes 32A-32D is comprised of, proceeding from left to right, an interior of the left side wall 28, the adjacent arcuate upper surface 26A of the base 26, and a left portion of a first divider wall 60 disposed within one of the channels 34 of the base 26 (lane 32A), a right portion of the first divider wall 60, the next adjacent arcuate upper arcuate surface 26B of the base 26, and a left portion of a second divider wall 60 disposed within one of the channels 34 (lane 32B), a right portion of the second divider wall 60, the next adjacent arcuate upper surface 26C of the base 26, and a left portion of a third divider wall 60 disposed within one of the channels 34 (lane 32C), a right portion of the third divider wall 60, the next adjacent arcuate upper surface 26D of the base 26, and an interior portion of the right side wall 30 (lane 32D).

It should be appreciated that the weight of the modular merchandise units 40 within the column of units 40 on the shelves 20 and the plurality of arcuate upper surfaces 26A-26D cooperate to provide an improved gravity feed for presenting modular merchandise units 40 and the primary product packaging 50 included therein to prospective consumers in a substantially upright and forward facing position.

Figure 4C:
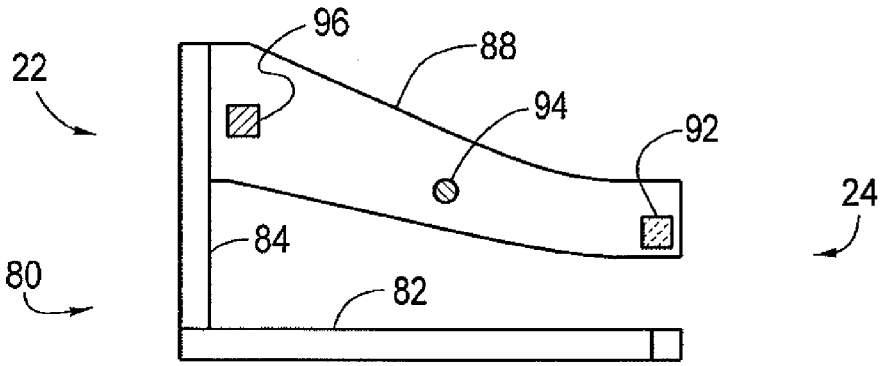
FIG. 4C is a side, partially cross sectional view of the support frame of FIG. 4A, taken along line 4C-4C of FIG. 4A.
Figure 4A:
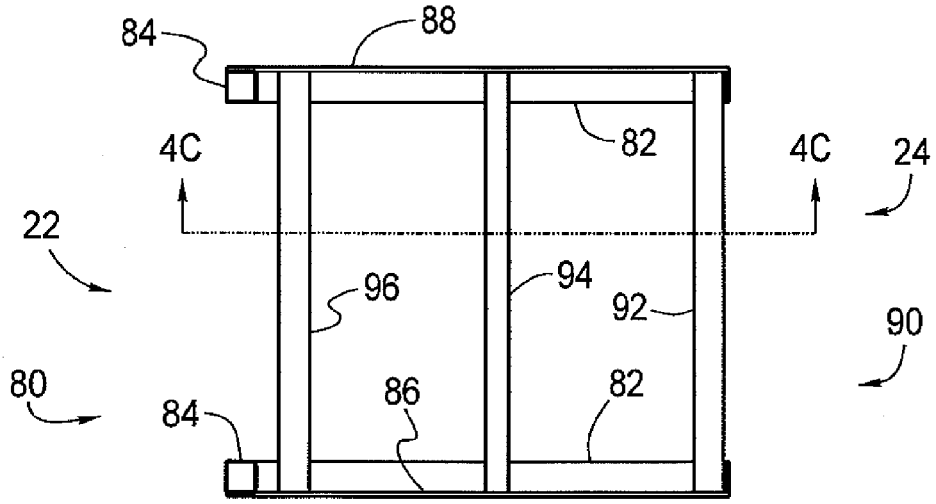
FIG. 4A is a plan view of a support frame, in accordance with one embodiment of the present invention, for supporting shelves of the merchandise display system.
Figure 4B:
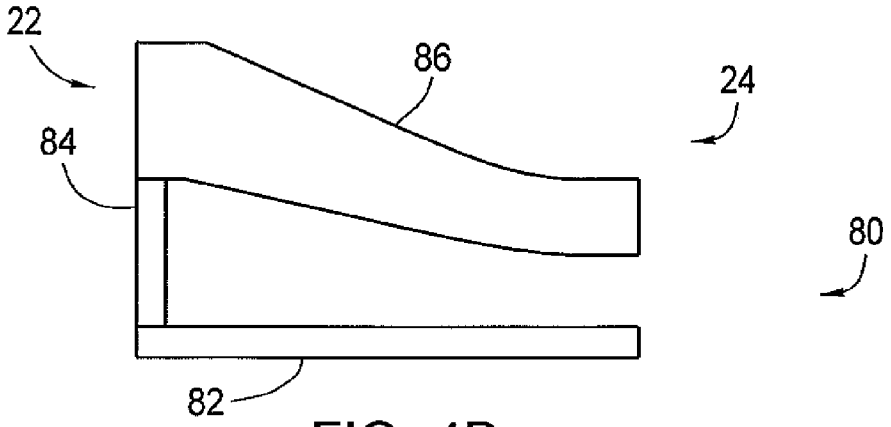
FIG. 4B is a side, elevational view of the support frame of FIG. 4A.

As shown in FIGS. 1 and 4A-4C, the merchandise display system 10 includes a support frame 80. In one embodiment, the support frame 80 is comprised of a base portion 82, an upright portion 84, a left side wall 86 and a right side wall 88 (left and right are from the perspective of a prospective consumer facing the front of the merchandising display system 10). In one embodiment, a plurality of support arms 90 traverse from the left side wall 86 to the right side wall 88 to support the base 26 of a corresponding one of the shelves 20. In one embodiment, illustrated in FIGS. 4A-4C, the support arms 90 include a first tubular arm 92 (e.g., a tubular arm having a square cross section) disposed in proximity to the dispensing end 24 of the merchandise display system 10, a second tubular arm 96 (e.g., a tubular arm having a square cross section) disposed in proximity to the loading end 22 of the system 10, and a support rod 94 disposed between the first tubular arm 92 and the second tubular arm 96. In one embodiment, a lower surface of each of the plurality of shelves 20 includes features for receiving the support arms 90. For example, and with reference to FIGS. 1, 3 and 4A, a forward receiving portion 36 and a rear receiving portion 37 of the shelves 20 are suitably sized to accept the first tubular arm 92 and the second tubular arm 96, respectively. A central receiving portion 38 of the shelves 20 is suitably sized to accept the support rod 94. As can be appreciated, the support arms 90 and the receiving portions 36, 37 and 38 cooperate to retain each of the shelves 20 within the support frame 80 of the merchandise display system 10. It should also be appreciated that other support means may secure the shelves 20 within the support frame 80. For example, the support arms 90 may be of various positions such as square or round tubes or rods, and the like. Additionally, it is within the scope of the present invention for the shelves 20 to independently support themselves between the left side wall 86 and the right side wall 88. While the display system 10 is shown in FIGS. 4A-4C as including only one shelf 20 supported by the support frame 80, a plurality of shelves 20 may be supported by the support frame in, for example, a vertically stacked arrangement. In one embodiment, lower shelves 20 extends a greater distance from the upright portion 84 then a next vertically higher shelf 20 to form an offset stacked or tiered arrangement of shelves generally referred to as a water fall type arrangement of shelves.

Figure 5B:
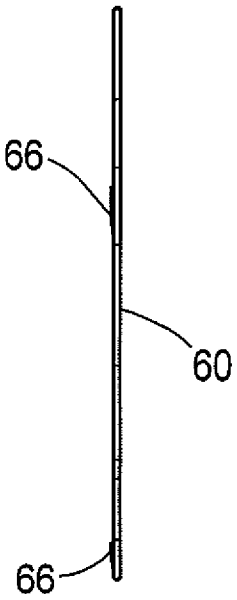
FIG. 5B is a rear elevational view of the divider of FIG. 5A.
Figure 5A:
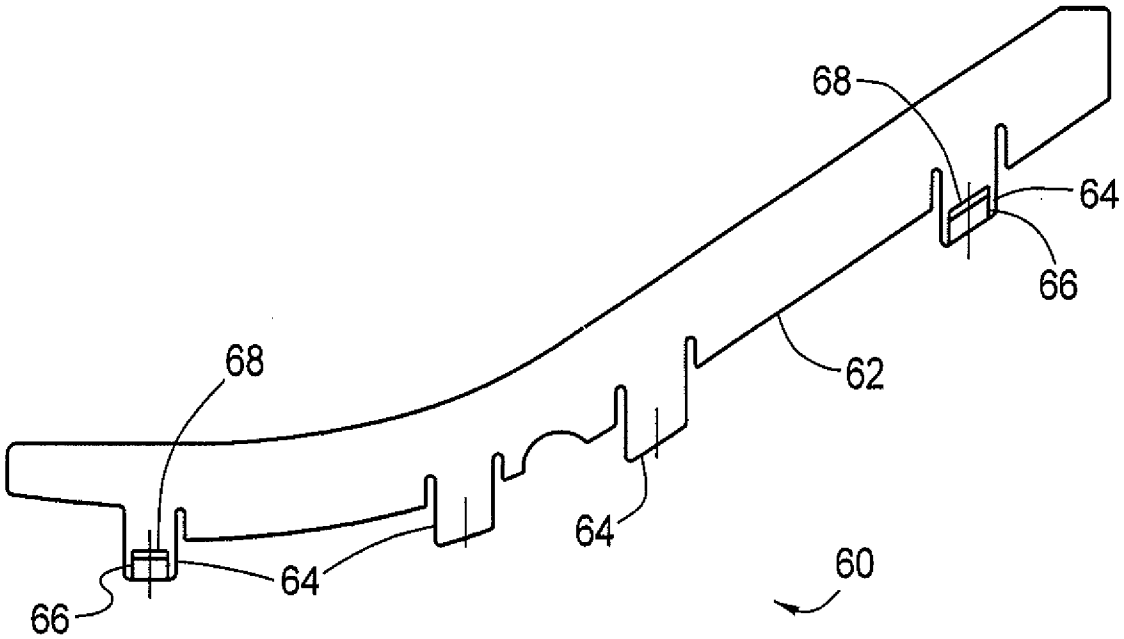
FIG. 5A is a side, elevational view of a divider, in accordance with one embodiment of the present invention, for partitioning the shelf of FIG. 2 into a plurality of channels.

In one embodiment, as shown in FIGS. 5A and 5B, each of the plurality of divider walls 60 is preferably arcuate and formed as a plurality of the radii comparable to the aforementioned radii R1-R4 that comprise the arcuate upper surfaces 26A-26D of the base 26. In this manner, a bottom surface of the divider walls follows the contour of the base 26 as the base 26 extends continuously upwardly from the dispensing end 24 to the rear end 22. In one embodiment, illustrated in FIGS. 5A and 5B, each of the divider walls 60 includes a bottom surface 62 and a plurality of projections 64 extending downwardly from the bottom surface 62. One or more of the projections 64 include fingers 66. In one embodiment, the divider walls 60 are suitably sized to be received by the channels 34 of the base 26 such that the projections 64 pass into slots 35 formed within the channels 34. The fingers 66 have an upper surface 68 advantageously securing or locking the divider walls 60 within the slots 35 of the channels 34. In one embodiment, the divider walls 60 are of a suitable height for preventing the modular merchandise units 40 from toppling over a divider from one lane to another (e.g., from lane 32A to 32B) as the modular merchandise units 40 traverse from the rear end 22 to the dispensing end 24. The inventor has also found that the divider walls 60 acts as rails countering skewing forces caused by the gravity-feed action as the modular merchandise units 40 traverse the upper surfaces 26A-26D of the base 26 from the rear end 22 to the dispensing end 24 of the merchandising system 10. As noted above, it is within the scope of the present invention for the divider walls 60 to be integrally formed within the base 26, or affixed thereto.

It should be appreciated that while each column of modular merchandise units 40 on the shelves 20 are shown in FIG. 1 as including three merchandise units 40 it is within the scope of the present invention for each of the shelves 20 to accommodate more than the three illustrated units 40. For example, it is within the scope of the present invention to extend the rearmost surface 26D4 having radius R4 beyond the dimension D4 and, more appropriately, extend the upper surfaces 26A-26D of the base 26 to accommodate additional modular merchandise units 40 within each column of units. Moreover, while the merchandise display system 10 is illustrated as including a front, dispensing end 24 and a rear end 22, it is within the scope of the present invention for modular merchandise units 40 to be loaded from either the front dispensing end 24 of the shelves 20 or from the rear end 22 of the shelves 20.

It should also be appreciated that while described as a merchandise display system for providing and exhibiting consumer merchandise within modular merchandise units to prospective consumers by an improved gravity feed arrangement, it is within the scope of the present invention to provide and exhibit consumer merchandise directly to consumers by means of the improved gravity feed arrangement. For example, the present invention is not limited to gravity feeding modular merchandise units and, thus, is operative for displaying consumer merchandise in its primary product packaging 50.

Figure 6:
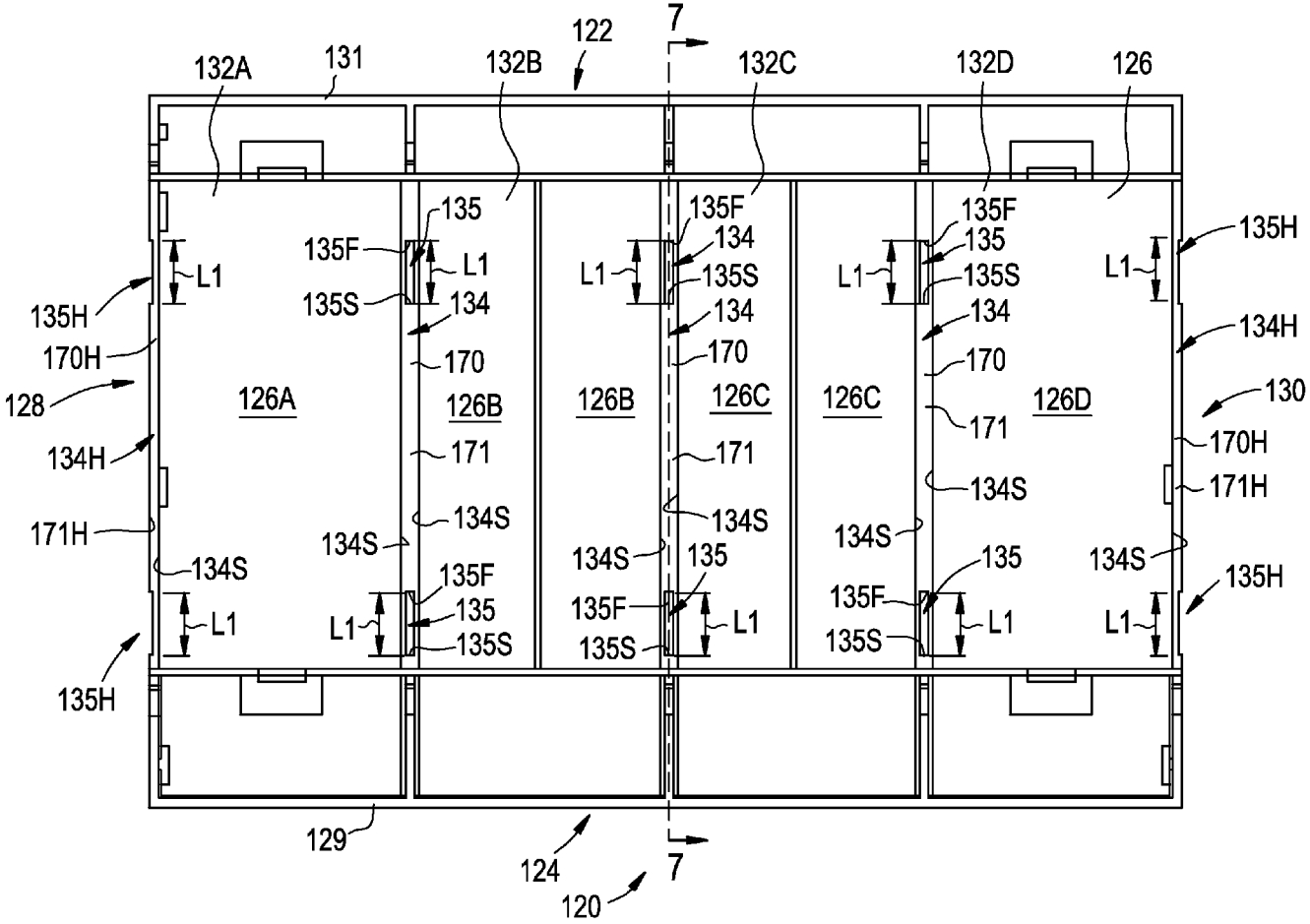
FIG. 6 is a plan view of another embodiment of a shelf configured to receive stowable lane dividers, in accordance with one embodiment of the invention, as illustrated in FIG. 1.
Figure 7:
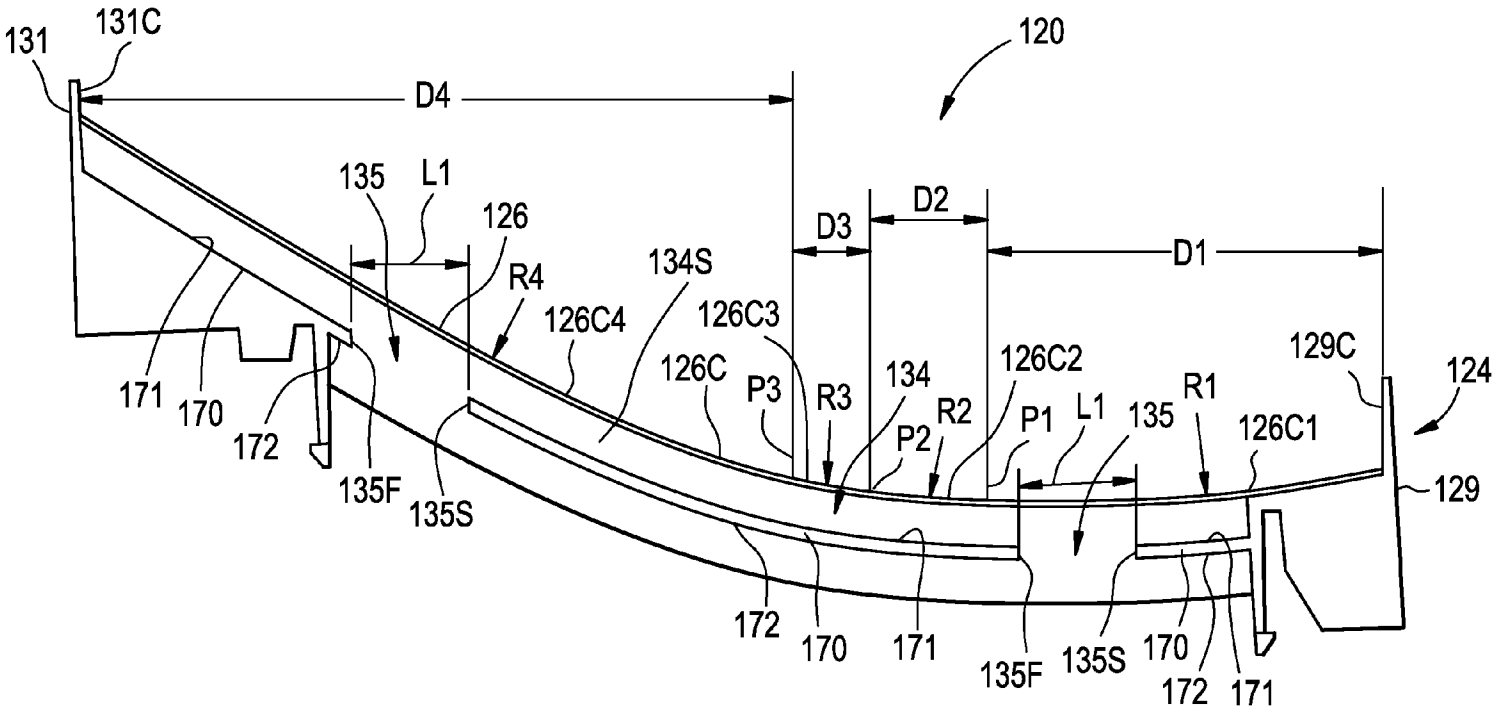
FIG. 7 is a side, elevation view of the shelf of FIG. 6, taken along line 7-7 of FIG. 6.

FIGS. 6-13 illustrate one embodiment of a shelf and lane divider assembly for use in the merchandise display system 10 of FIG. 1. The shelf and lane divider assembly of FIGS. 6-13 includes shelves and stowable lane dividers which are similar to the shelves 20 and dividers 60 illustrated in FIGS. 2, 3, 5A and 5B. Accordingly, like elements have been assigned like element numbers, preceded by the numeral 1. However, the shelf 120 is shown with the left and right side walls or endcaps removed. Thus element numbers 128 and 130 refer generally to left and right sides of the shelf 120, respectively. In addition, since FIG. 7 is a cross section elevation view through section 7-7 of FIG. 6, the tangent radii (R1, R2, R3 and R4) and plurality of arcuate surfaces (126C1, 126C2, 126C3 and 126C4) are, for example, shown for the continuous arcuate surface 126C, However, the dimensions and configuration of the tangent radii (R1, R2, R3 and R4) and plurality of arcuate surfaces (126C1, 126C2, 126C3 and 126C4) correspond to those described above for the plurality of arcuate surfaces (26D1, 26D2, 26D3 and 26D3) of FIG. 3 and apply to the continuous arcuate surfaces 126A, 126B, 126C and 126D.

Figure 8:
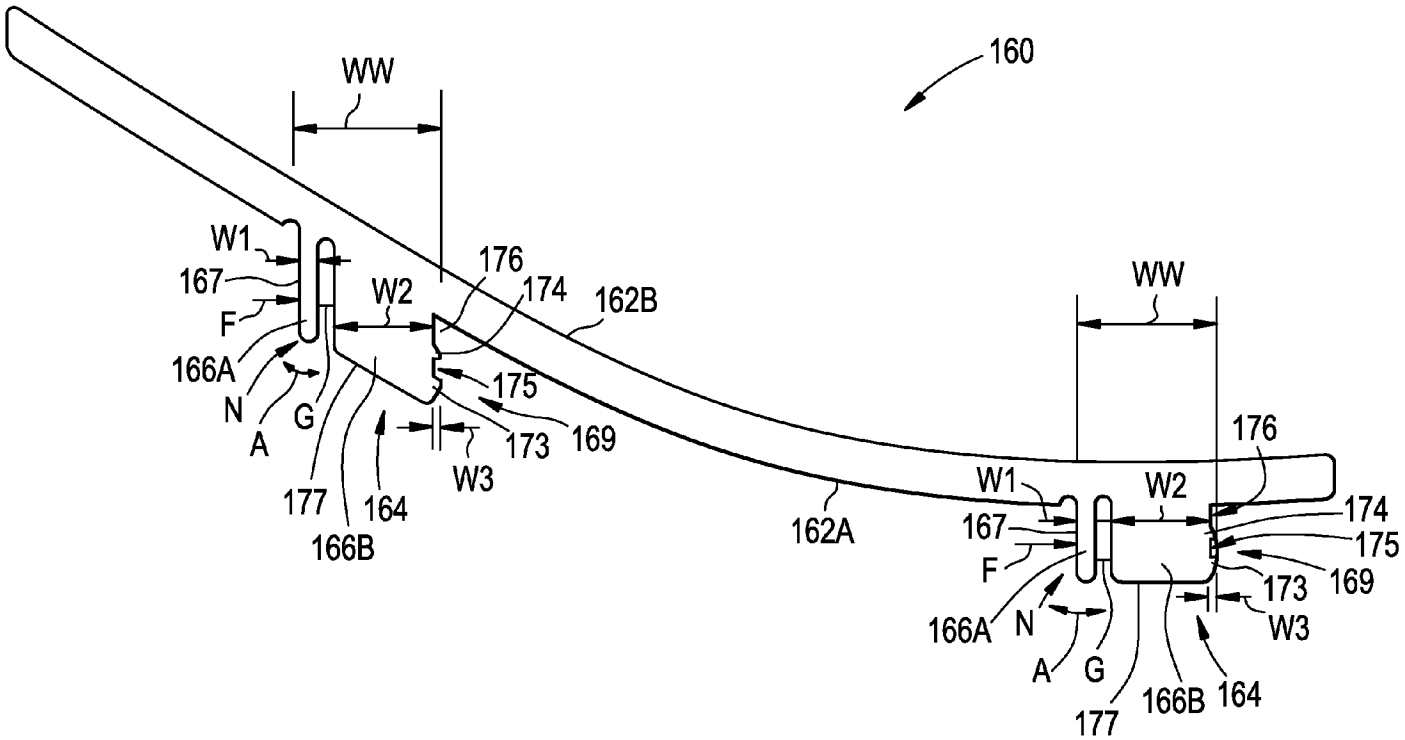
FIG. 8 is a side, elevation view of one of the stowable lane dividers, in accordance with one embodiment of the present invention, for partitioning the shelf of FIG. 6 into a plurality of channels.
Figure 9:
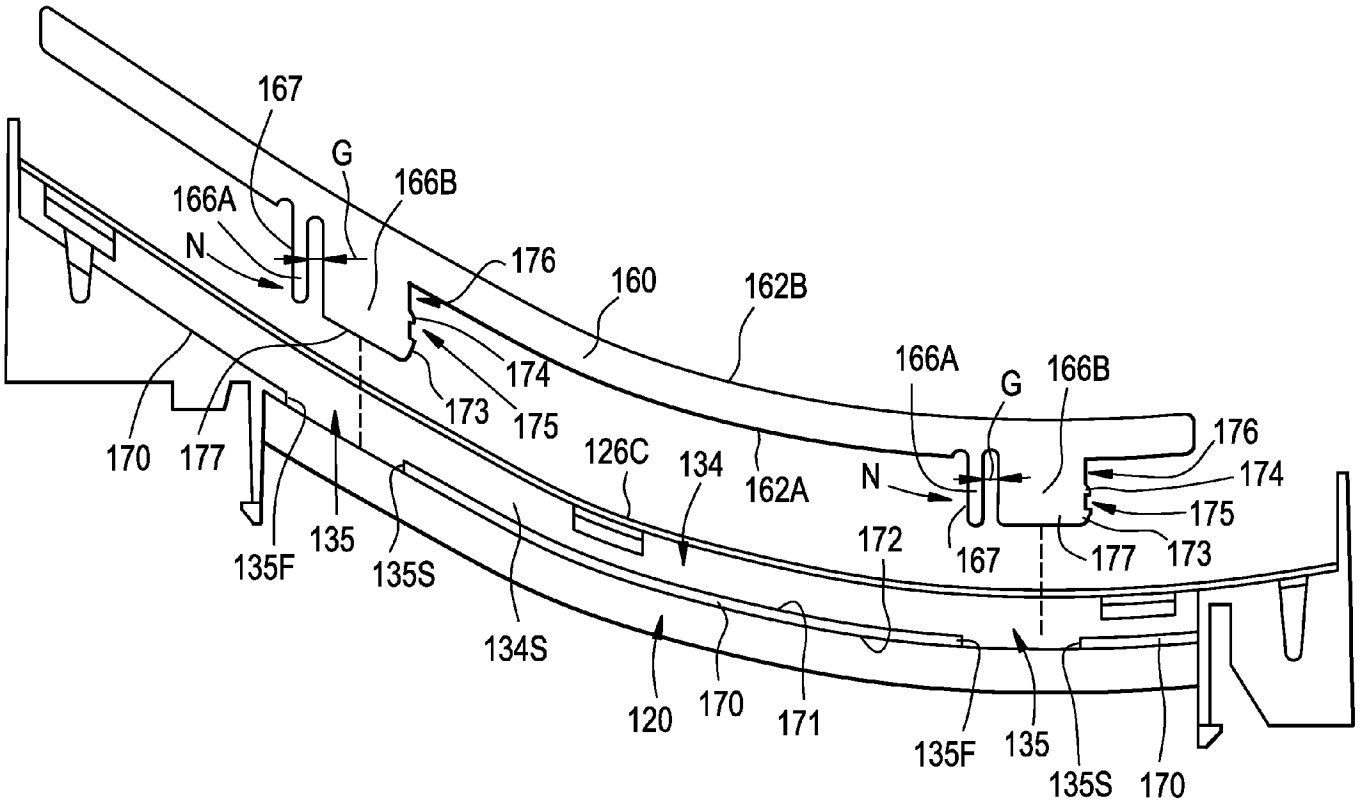
FIG. 9 is a side, exploded elevation view of one of the stowable lane dividers of FIG. 8 shown removed from the shelf of FIG. 6.

The shelves 120 and stowable lane dividers 160 of FIGS. 6-13 are capable of being selectively positionable relative to the shelves 120 in a stowed position (FIG. 13) and/or a deployed position (FIGS. 11 and 12), as described below. In addition, the stowable lane dividers 160 can be removed from the shelves (FIG. 9). Positioning the stowable lane dividers 160 in the stowed position prevents loss of the stowable lane divider by maintaining a connection between the shelf 120 and each of the stowable lane dividers.

As shown in FIG. 6, the shelf 120 includes: 1) a channel 134 between lanes 132A and 132B, 2) another channel 134 between lanes 132B and 132C and 3) another channel 134 between lanes 132C and 132D. In addition, a portion of a channel, for example a half channel 134H is formed on the left side 128 of the shelf 120 and another half channel 134H is formed on the right side 130 of the shelf. In one embodiment, another one of the shelves 120 is secured to the shelf 120 shown in FIG. 6 such that the half channels 134H of each of the shelves cooperate with one another to form another of the channels 134 between the shelves. In one embodiment, the half channels 134H cooperate with complementary half channels (not shown) formed in end caps (not shown) which are secured to the left side 128 and/or the right side 130 of the shelf 120, thereby forming another channel substantially equivalent in size and configuration to the channels 134. The following description of the channels 134 also applies generally to pairs of the half channels 134H, with the understanding that pairs of the half channels define a seem (not shown) at a location where the half channels cooperate with one another.

In one embodiment, as shown in FIGS. 6 and 7, each of the channels 134 is defined by two inwardly facing surfaces 134S and a floor structure 170 extending therebetween. The floor structure 170 defines a generally upwardly facing surface 171 and a downwardly facing surface 172, on opposing sides of the floor structure. The channels 134 are configured to receive and retain the stowable lane dividers 160 between the inwardly facing surfaces 134S and adjacent to at least a portion of the floor structure 170, as described below.

While the channels 134 are shown and described as being defined by two inwardly facing surfaces 134S and a floor structure 170 extending therebetween which defines a generally upwardly facing surface 171, the present invention is not limited in this regard as other channel configurations may be employed including but not limited to channels defined by a plurality of interconnected ribs and/or bars, perforated plates, nets, screens and combinations thereof, without departing from the broader aspects disclosed herein.

In one embodiment, as illustrated in FIGS. 6 and 7, a plurality of openings, for example, two slots 135 extend through the floor structure 170, between the upwardly facing surface 171 and the downwardly facing surface 172. The inwardly facing surfaces 134S extend into each of the slots 135. Each of the slots 135 define a first abutment surface 135F and a second abutment surface 135S, each of which selectively abut portions of the stowable lane dividers 160 to selectively position the stowable lane dividers relative to the shelves 120, as described below. In one embodiment, the slots 135 have a length L1 suitable to accommodate of a plurality of projections 164, described below, extending from the stowable lane dividers 160. In one embodiment, each of the first and second abutment surfaces 135F and 135S extend between the inwardly facing surfaces 134S and between the upwardly facing surface 171 and the downwardly facing surface 172, on opposing sides of each of the slots. The half channels 134H are configured similar to the channels 134 but define one inwardly facing surface 134S, a half floor structure 170H and a half slot 135H.

Although the slots 135 are shown and described as defining a first abutment surface 135F and a second abutment surface 135S, extending between the inwardly facing surfaces 134S and between the upwardly facing surface 171 and the downwardly facing surface 172, the present invention is not limited in this regard as other abutment surface configurations may also be employed including but not limited to the use of pins, rods, protrusions and the like extending from the base and/or between the inwardly facing surfaces 134S, without departing from the broader aspects disclosed herein.

In one embodiment, as shown in FIG. 8, each of the stowable lane dividers 160 are suitably sized to be received by the channels 134 of the base 126. For example, each of the stowable lane dividers 160 can have a thickness of about 0.1 inches. In one embodiment, each of the stowable lane dividers 160 includes a bottom surface 162A, an arcuate top surface 162B, which is of a shape complementary to the arcuate surfaces 126C1, 126C2, 126C3 and 126C4. Each of the stowable lane dividers 160 is shown, for example, having a plurality of projections 164 extending downwardly from the bottom surface 162A. One or more of the projections 164 include a plurality of fingers, for example a first finger 166A and a second finger 166B, spaced apart from one another by a predetermined distance, for example a gap G.

The first finger 166A has a width W1 as measured between an edge adjacent to the gap G and another edge on an opposing side of the first finger. A bearing surface 167 is defined by the edge on the opposing side of the first finger 166A. In addition, the first finger 166A is sized (e.g., has the width W1) and configured to elastically deflect in the general direction indicated by the arrow A in response to application and removal of a lateral force F applied to the bearing surface 167. In the embodiment of FIG. 8, the first finger 166A is shown in a neutral N position wherein the force F is about zero.

The second finger 166B has a width W2 measured between an edge adjacent to the gap G and another edge on an opposing side of the second finger. The width W2 is greater than the width W1 of the first finger 166A. Each of the projections 164 is sized to be removably positionable in one of the slots 135. For example, the sum of the widths W1 and W2 and the width of the gap G are determined to provide a friction or mechanical connection in cooperation with the length L1 of the slots 135 to secure the stowable lane divider 160. In addition, the second finger 166B includes a plurality of protrusions 169 extending from the edge opposite the gap G. In one embodiment, the protrusions 169 include a first lobe 173 and a second lobe 174 which extend from the edge opposite the gap G by a width of about W3 and define a first recess 175 therebetween. In addition, a second recess 176 is defined between the second lobe 174 and an adjacent portion of the bottom surface 162A of the stowable lane divider 160. The overall width WW (FIG.8) of each of the projections 164, including the width of the lobes 173 and 174 (i.e., the sum of the widths W1, W2, W3 and G) are determined to cooperate with the length L1 of one of the respective slots 135. In addition, each of the second fingers 166B define a base portion 177 which serve as a surface for application of a force suitable to urge the stowable lane dividers 160 upwardly and/or out of the channels 134, as explained below.

Referring to FIG. 9, the stowable lane divider 160 is shown removed from the shelf 120 which leaves the channel 134 and slots 135 open.

Figure 10:
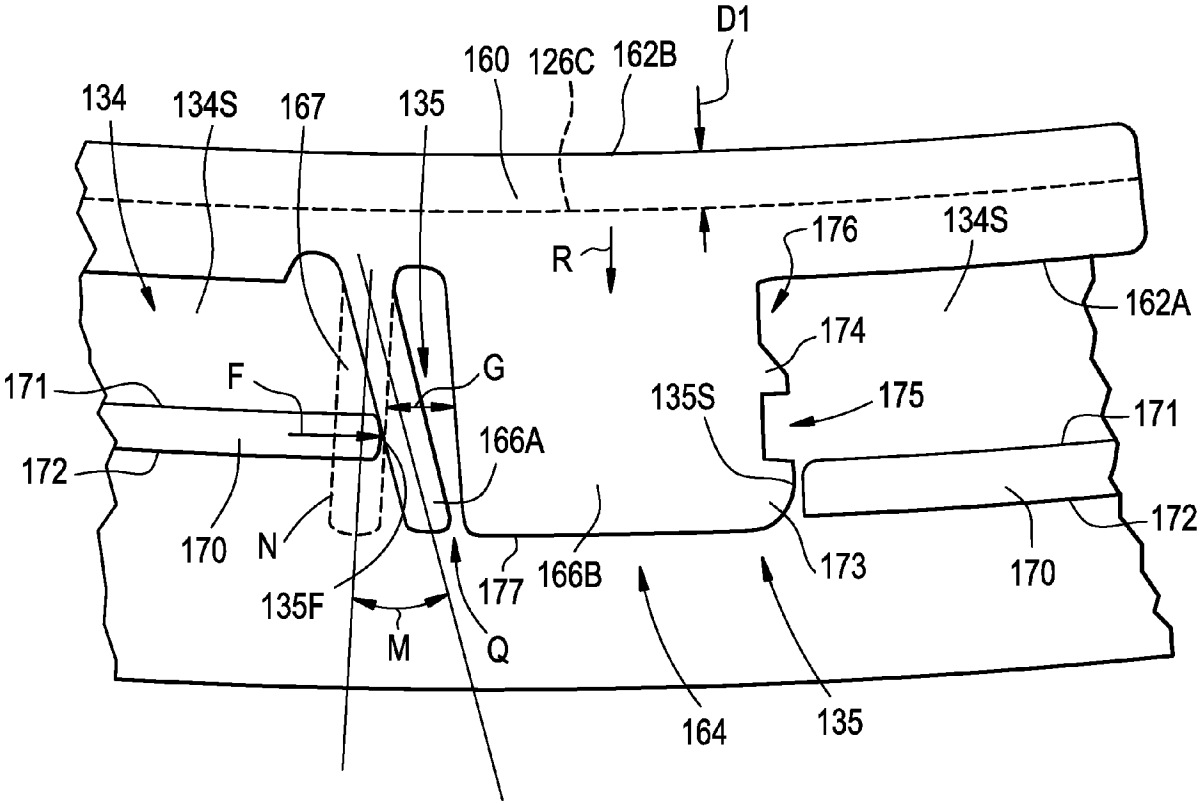
FIG. 10 is an enlarged view of a portion of the stowable lane divider and shelf shown during installation and positioning into a deployed position.

In FIG. 10, the stowable lane divider 160 is shown at an initial step of being selectively positioned in the deployed position. At the initial step, the first finger 166A and the second finger 166B, of each projection 164, are urged downwardly in the direction of the arrow R into a respective one of the slots 135 so that the first abutment surface 135F engages the bearing surface 167 of the first finger and the second abutment surface 135S engages the first lobe 173. Since the overall width WW of the projection 164 is greater than the length L1 of the slot 135, the first abutment surface applies a reaction force F to the bearing surface 167 thereby causing the first finger 166A to deflect from the neutral position N (see FIGS. 8 and 9 and the first finger shown in dashed lines in FIG. 10) towards the second finger 166B, to the deflected position Q. The first finger 166A deflects to an angle M relative to the neutral position N, thereby allowing each of the projections 164 to be inserted into a respective one of the slots 135.

Figure 11:
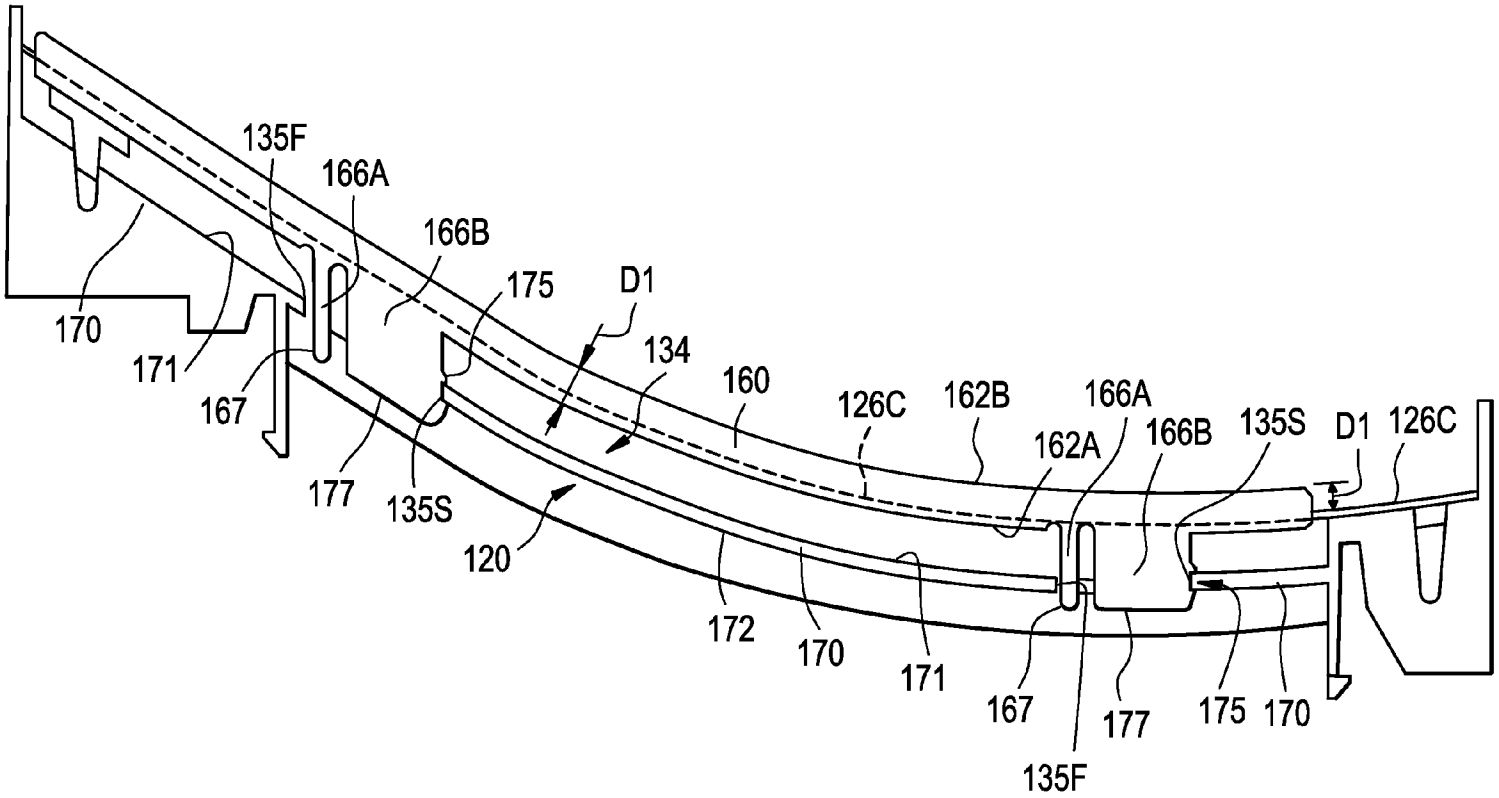
FIG. 11 is a side, elevation view of one of the stowable lane dividers of FIG. 8 shown in the deployed position.
Figure 12:
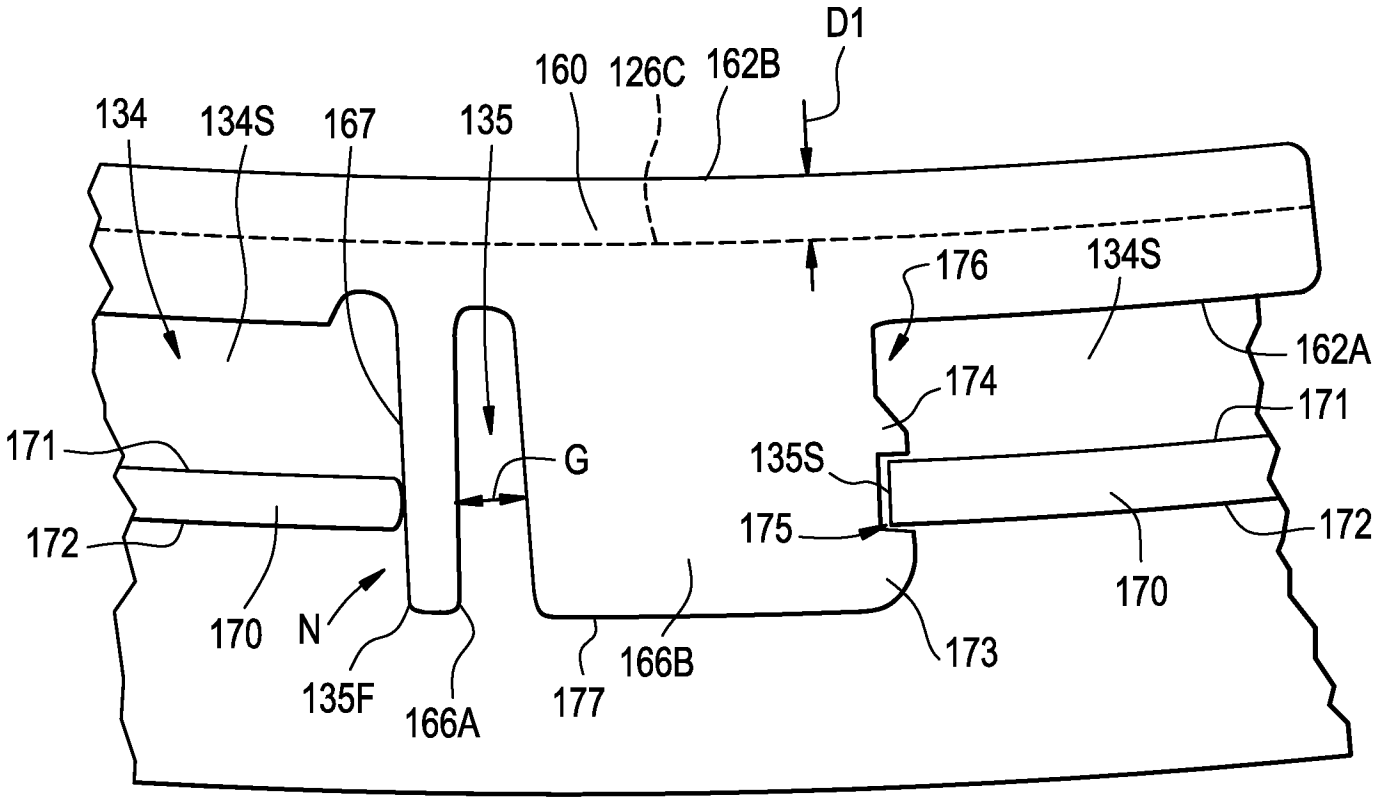
FIG. 12 is an enlarged view of a portion of the stowable lane divider and shelf of FIG. 11.

Further urging of the stowable lane divider 160 downwardly in the direction R: 1) causes the second abutment surface 135S to traverse the first lobe 173 and seat in the first recess 175; and 2) allows the first finger 166A to return to the neutral position N, for each of the projections 164, thereby removably locking each of the projections in one of the respective the slots 135 as shown in FIGS. 11 and 12. In the deployed position, each pair of the first and second fingers 166A and 166B are selectively positioned in one of the slots 135 such that the arcuate top surface 162B of the stowable divider 160 extends above the arcuate surface 126C of the shelf 120 by a distance D1. The distance D1 is selected so that the stowable lane dividers 160 act as rails that counter skewing forces caused by the gravity-feed action as the modular merchandise units 40 traverse the upper surfaces 126A-126D of the base 126 from the rear end 122 to the dispensing end 124 of the merchandising system 10. In one embodiment, the slot 135 is configured and sized to apply a force to the bearing surface 167 to deflect the first finger 166A from the neutral position N, while the stowable lane divider 160 is in the deployed position.

Figure 13:
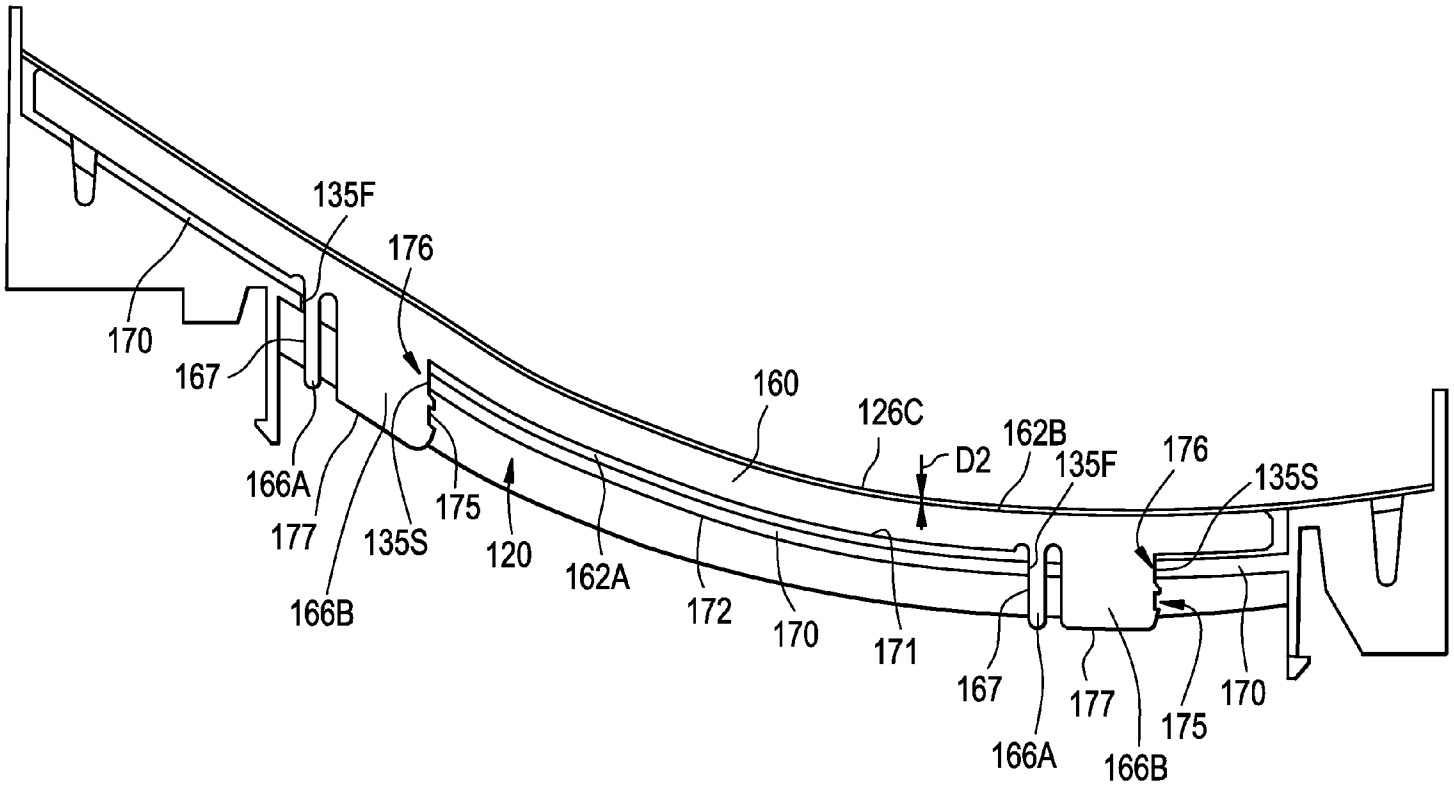
FIG. 13 is a side, elevation view of one of the stowable lane dividers of FIG. 8 shown in a stowed position.

Further urging of the stowable lane divider 160 downwardly from the deployed position in the direction shown by the arrow R toward an intermediate position (not shown): 1) causes the first finger 166A to deflect to another deflected position (not shown) similar to the deflected position Q of FIGS. 10; and 2) causes the second abutment surface 135S to move out of the first recess 175, for each of the projections 164, thereby allowing each of the projections 164 to move in one of the respective slots 135 toward the stowed position as shown in FIG. 13.

Further urging of the stowable lane divider 160 downwardly from the intermediate position in the direction R: 1) causes the first finger 166A to traverse the second lobe 174; 2) allows the second abutment surface 135S to seat in the second recess 176; and 3) allows the first finger to return to the neutral position N, for each of the projections 164, thereby allowing each of the projections 164 to become removably locked in one of the respective slots 135, in the stowed position as shown in FIG. 13.

In the stowed position, each pair of the first and second fingers 166A and 166B of one or more of the stowable lane dividers 160 are selectively positioned in one of the slots 135 such that the arcuate top surface 162B of the stowable divider is recessed below the arcuate surface 126C of the shelf 120 by a distance D2. In one embodiment, the top surface 162B is level or even with the arcuate surface 126C. Positioning the stowable lane dividers 160 below or level with the arcuate surface 126C allows the modular merchandise units 40 to traverse the upper surfaces 126B and 126C of the base 126 from the rear end 122 to the dispensing end 124 of the merchandising system 10 without engaging the arcuate upper surface 162B of the stowable lane divider. In one embodiment, in the stowed position, the bottom surface 162A of the stowable lane divider 160 engages and or seats in at least a portion of the upwardly facing surface 171 of the floor structure 170 of the channel 134. In one embodiment, the slot 135 is configured and sized to apply a force to the bearing surface 167 to deflect the first finger 166A from the neutral position N, while the stowable lane divider 160 is in the stowed position.

The stowable lane dividers 160 can be selectively moved from the stowed position to the deployed position and/or removed from the shelf 120 by applying an upwardly directed force (i.e., opposite to the direction of the arrow R) to one or more of the projections 164, for example by applying an upwardly directed force to each of the bases 177 of the second fingers 166B.

Although the invention has been described with reference to particular embodiments thereof, it should be understood by one of ordinary skill in the art, upon a reading and understanding of the foregoing disclosure that numerous variations and alterations to the disclosed embodiments will fall within the spirit and scope of this invention and of the appended claims.

What is claimed is:

1. A gravity-feed shelf of a merchandise display system, the shelf comprising:

a base having a front dispensing end, a rear end, and an arcuate upper surface extending continuously upwardly from the front dispensing end to the rear end;

a plurality of channels formed in the arcuate upper surface;

a plurality of divider walls each removably secured to a portion of a respective one of the channels and selectively positionable in at least one of a deployed position and a stowed position, in the deployed position the divider walls extend above the arcuate upper surface and in the stowed position the divider walls are disposed in the channel and are recessed below or level with the arcuate surface;

wherein in the deployed position, pairs of the divider walls cooperate with one another and the arcuate surface to define a lane between the divider walls, the lane being dimensioned to accommodate a front to back column of merchandise items; and wherein when the merchandise item is placed at the rear end of the lanes, the merchandise item traverses the lane by gravity to the front dispensing end of the lane such that the merchandise item is presented to a prospective consumer in a substantially upright and forward facing position.

2. The gravity feed shelf of claim 1, wherein the arcuate upper surface is formed as a plurality of surfaces extending continuously as tangent radii from the front dispensing end to the rear end of the base.

3. The gravity-feed shelf of claim 1, wherein the merchandise items include a plurality of modular merchandise units, and wherein each of the modular merchandise units retain a plurality of primary merchandise packaging.

4. The gravity-feed shelf of claim 1, wherein the base further includes a left side wall and a right side wall integrally formed therewith.

5. The gravity-feed shelf of claim 1, wherein the channels are disposed laterally and in a front to back arrangement along the base to define widths of the lanes, and wherein the channels include at least one set of channels disposed in proximity to each other at one of the lanes such that a width of the one lane is selectively widened and narrowed to accommodate various widths of the merchandising items.

6. The gravity-feed shelf of claim 1, wherein the divider walls define a plurality of projections extending therefrom and wherein the channels define a plurality of slots extending therethrough, and each of the plurality of projections being selectively positionable in one of the plurality of the slots to moveably secure the divider wall in at least one of the deployed position and the stowed position.

7. The gravity-feed shelf of claim 6, wherein:

the projections comprise a first finger and a second finger spaced apart from one another;

each of the slots define a plurality of abutment surfaces; and wherein each of the first and second fingers selectively engage one of the abutment surfaces to moveably secure the divider wall in at least one of the deployed position and the stowed position.

8. The gravity-feed shelf of claim 7, wherein the second finger include a first recess which cooperates with one of the abutment surfaces to selectively secure the divider wall in the deployed position and a second recess which cooperates with the abutment surface to selectively secure the divider wall in the stowed position.

9. A merchandise display system, comprising:

a support frame;

a plurality of shelves disposed on the support frame, each shelf having a base, a front dispensing end and a rear end, the base including an arcuate upper surface extending continuously upwardly from the front dispensing end to the rear end;

a plurality of channels formed in the arcuate upper surface;

a plurality of divider walls each removably secured to a portion of a respective one of the channels and selectively positionable in at least one of a deployed position and a stowed position, in the deployed position the divider walls extend above the arcuate upper surface and in the stowed position the divider walls are disposed in the channel and are recessed below or level with the arcuate surface;

wherein in the deployed position, pairs of the divider walls cooperate with one another and the arcuate upper surface to define a lane between the pair of divider walls, the lane being dimensioned to accommodate a front to back column of merchandise items; and wherein when the merchandise item is placed at the rear end of the lanes, the merchandise item traverses the lane by gravity to the front dispensing end of the lane such that the merchandise item is presented to a prospective consumer in a substantially upright and forward facing position.

10. The merchandise display system of claim 9, wherein the arcuate upper surface is formed as a plurality of surfaces extending continuously as tangent radii from the dispensing end to the rear end of the base.

11. The merchandise display system of claim 9, wherein the merchandise items include a plurality of modular merchandise units, and wherein each of the modular merchandise units retain a plurality of primary merchandise packaging.

12. The merchandise display system of claim 9, wherein the base further includes a left side wall and a right side wall integrally formed therewith.

13. The merchandise display system of claim 9, wherein the channels are disposed laterally and in a front to back arrangement along the base to define widths of the lanes, and wherein the channels include at one set of channels disposed in proximity to each other at least one of the lanes such that a width of the one lane is selectively widened and narrowed to accommodate various widths of the merchandising items.

14. The merchandise display system of claim 9, wherein the divider walls define a plurality of projections extending therefrom and wherein the channels define a plurality of slots extending therethrough, and each of the plurality of projections being selectively positionable in one of the plurality of the slots to moveably secure the divider wall in at least one of the deployed position and the stowed position.

15. The merchandise display system of claim 14, wherein:

the projections comprise a first finger and a second finger spaced apart from one another;

each of the slots define a plurality of abutment surfaces; and wherein each of the first and second fingers selectively engage one of the abutment surfaces to moveably secure the divider wall in at least one of the deployed position and the stowed position.

16. The merchandise display system of claim 15, wherein the second finger include a first recess which cooperates with one of the abutment surfaces to selectively secure the divider wall in the deployed position and a second recess which cooperates with the abutment surface to selectively secure the divider wall in the stowed position.

* * * * *